US005988231A

United States Patent [19]

Blake

[11] Patent Number: 5,988,231

[45] **Date of Patent: *Nov. 23, 1999**

[54] VALVE STEM FOR TRANSFERRING FLUID BETWEEN SEALED CONTAINERS

[75] Inventor: Robert R. Blake, La Florida Naucalpan, Mexico

[73] Assignee: Precision Valve Corporation, Yonkers, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/658,804

[22] Filed: Jun. 7, 1996

[51] Int. Cl.[6] ..... B65B 1/04

[52] U.S. Cl. ..... 141/21; 141/18; 141/293; 141/296; 141/348; 141/349; 141/379

[58] Field of Search ..... 141/18, 21, 293, 141/296, 348, 349, 351, 352, 353, 357, 360, 363, 364, 366, 367, 379

[56] References Cited

U.S. PATENT DOCUMENTS

| | | | |
|---|---|---|---|
| 3,217,762 | 11/1965 | Burchett | 141/293 |
| 3,240,430 | 3/1966 | Diamond | 141/352 |
| 3,307,595 | 3/1967 | Berning et al. | 141/293 |
| 3,756,472 | 9/1973 | Vos | 222/189 |

*Primary Examiner*—David J. Walczak
*Assistant Examiner*—Timothy L. Maust
*Attorney, Agent, or Firm*—Kilgannon & Steidl

[57] ABSTRACT

This invention concerns an aerosol valve stem configuration wherein the discharge end of the valve stem has a distortable membrane flange extending therefrom. The distortable membrane flange permits accommodation of filling lighters wherein the pin in the lighter opener is either of the centrally disposed orifice through the pin or of the orifice being disposed through the side wall of the pin.

9 Claims, 2 Drawing Sheets

FIG. 1
PRIOR ART
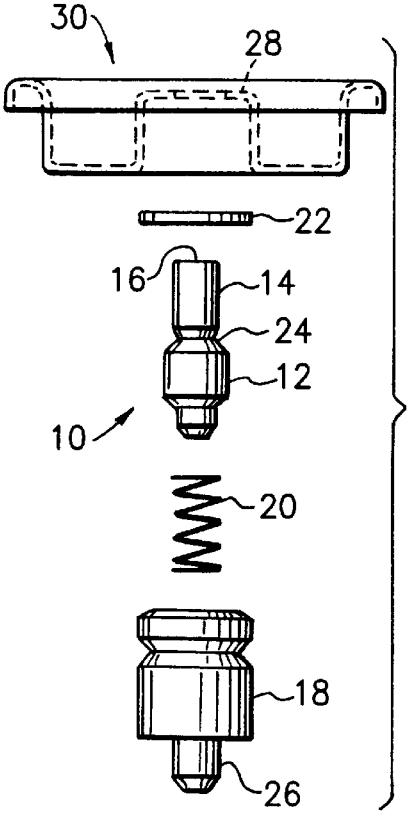
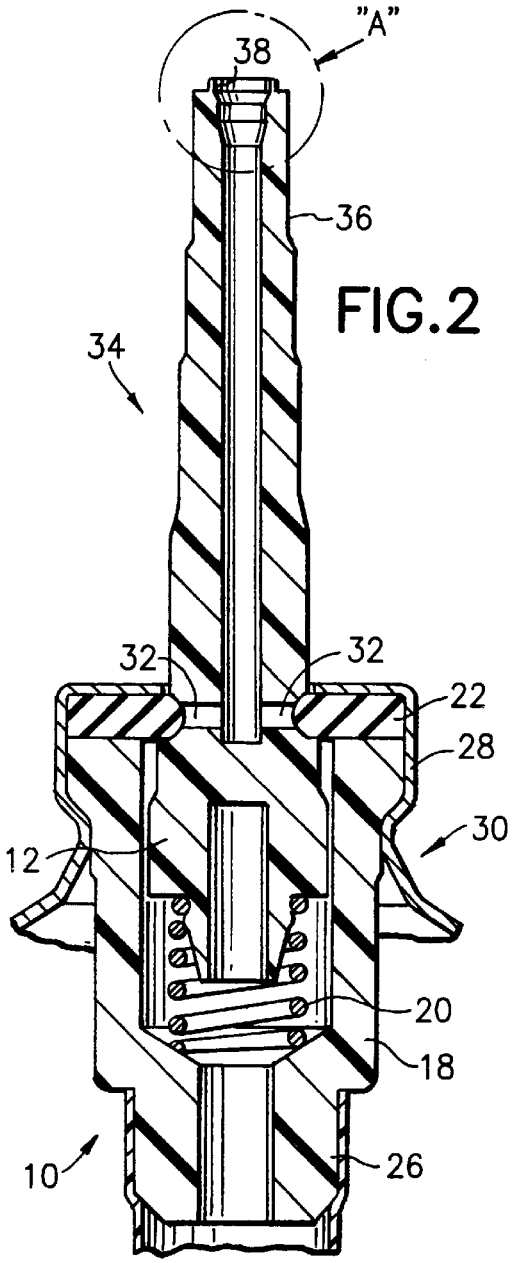
FIG. 2
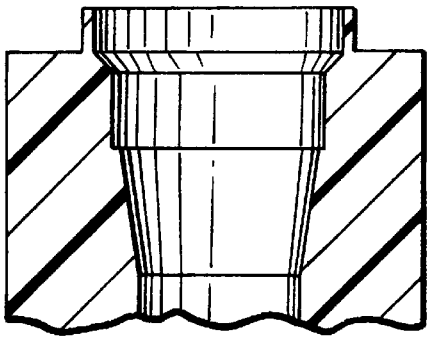
FIG. 5

VALVE STEM FOR TRANSFERRING FLUID BETWEEN SEALED CONTAINERS

The present invention relates generally to an aerosol valve and, in particular, to an improved valve stem component of said aerosol valve.

In pressurized containers such as, for example, butane fuel, the pressurized product is transferred from its storage container to a valved cigarette lighter through insertion of a valve stem into a valved filler opening in the cigarette lighter and concomitant opening of the aerosol valve by depressing the valve stem to thereby cause flow of fuel from the storage container to the storage cavity in the cigarette lighter. In pressurized containers heretofore, the valve stem which is inserted into the filler opening of, say a cigarette lighter, in order to transfer the lighter fluid from the pressurized container to the lighter, the stem had a terminal edge of uniform thickness. Lighters of one principal lighter manufacturer are of two constructions as regards the entry port for the lighter fluid. In one construction, there is a centrally disposed depressible pin having an entry port or orifice therethrough and in the other construction, there is a centrally disposed depressible pin having an entry port or orifice extending through the side wall of the depressible pin. As a consequence, with prior pressurized containers, insertion of the valve stem into the lighter opening resulted in a sealing of the entry port in lighters having a central pin with the entry port in side wall of the pin and consequent by-pass and leakage of the fuel to the atmosphere. That is, with valve stems of the prior art insertion of the stem would cause the stem to seal against the orifice-less pin and the product would not be transferred from the pressurized container to the interior of the lighter. To overcome this problem, it has been necessary in the past to provide an adaptor that fits over the valve stem when the lighter to be filled had an entry port in the side wall of the pin.

SUMMARY OF THE INVENTION

According to the present invention, a valve stem for a pressurized container has a deformable membrane flange extending from the discharge end of the stem, which flange is capable of having its leading edge distorted upon insertion of the valve stem into the lighter filling opening. The formation of the distortion functions to seal the pressurized container and the lighter and yet allow the efficient transfer of the aerosol product to the interior of the lighter through the side entry port or the centrally disposed entry port in the pin of the lighter.

As noted above, a leading manufacturer of lighters employs several mechanisms for sealing and filling the lighter. In one form, the entry port for filling the lighter has a pin with an orifice therethrough for admitting the lighter fuel to the interior of the lighter. In another form, the entry port for filling the lighter has an orifice-less pin with the entry port or orifice for admitting the fuel extending through the side wall of the pin.

With the valve stem of this invention, the delivery of product from the aerosol container to a valved chamber having a pin valve with an orifice for entry of product or an orifice-less pin valve having the entry port to the chamber in the side wall of the pin, is accomplished. The valve stem of the subject invention accommodates both forms of pin valve.

The valve stem of this invention may be used together with the other conventional parts of an aerosol valve.

It is a further feature of the subject invention that there be oppositely positioned entry orifices at the base of the valve stem. Due to the length of the valve stem in lighter fluid aerosol containers, it has been found that where a single entry port is used, the valve stem flaps. Through the use of oppositely opposed entry ports communicating the container interior to the hollow valve stem, the valve stem is stabilized.

In a conventional aerosol valve, there is provided a mounting cup which forms a closure when appropriately joined to the container. The mounting cup conventionally has a centrally disposed pedestal portion in which the valve housing is clinched. The valve stem has a lower body portion and a transverse port or ports that permit the product within the container to pass into a hollow valve stem. The valve body is conventionally disposed within the housing and the port leading to the hollow valve stem is surrounded and closed off when the aerosol valve is in a non-actuated position by an encircling gasket. Actuation of the valve is accomplished by manual or other force directed against the valve stem to move the port in the valve stem within the container and away from the encircling gasket. A spring disposed beneath the body of the valve stem returns the aerosol valve to a closed or non-actuated position when the manual force against the valve stem is removed.

The valve stem of the subject invention will hereafter be described by reference to the drawings.

BRIEF DESCRIPTION OF THE DRAWINGS

FIG. 1 is an exploded view of an aerosol valve of the prior art.

FIG. 2 is a partial sectional view of the aerosol valve of this invention.

FIG. 5 is an enlarged view of "A" of FIG. 2.

DETAILED DESCRIPTION

Figure 3:
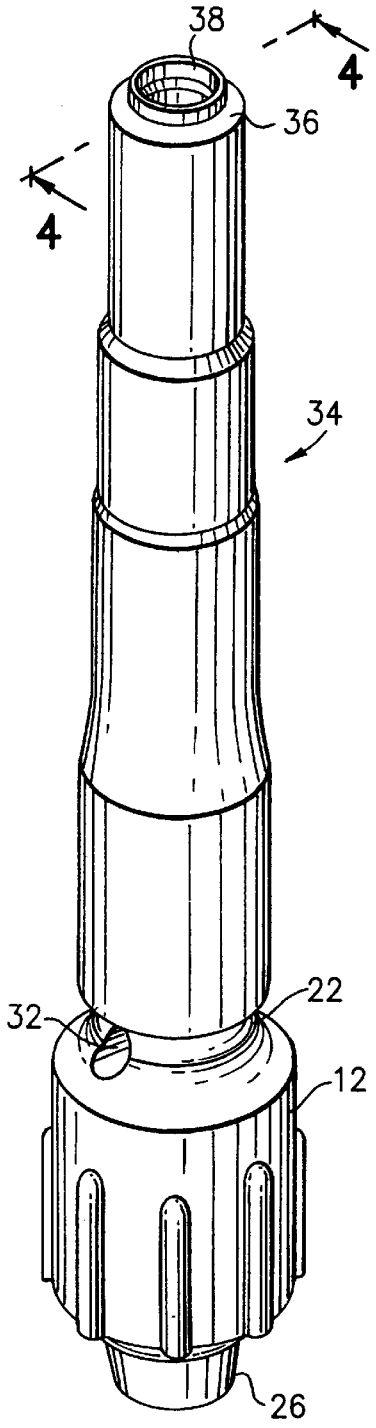
FIG. 3 is a perspective view of the aerosol valve stem and valve body of this invention.

In FIG. 1, there is shown an aerosol valve of the prior art, generally designated as 10, having a body portion 12, a hollow stem portion 14, which hollow stem portion 14 terminates in a discharge orifice 16. When assembled, the body portion 12 is disposed within the housing 18. A spring 20 is disposed in the housing 18 beneath the body portion 12. A gasket 22, when the valve is assembled, encircles the recess 24 and functions to close off the entry port(s) (not shown) in the recess 24 of the valve body/stem.

When discharging a product such as butane fuel, there is no need to have a dip tube attached to the nozzle 26 of the valve housing 18.

The aerosol valve, generally designated as 10, is clinched into the pedestal portion 28 of the mounting cup, generally designated as 30, in a conventional manner.

In FIG. 2, corresponding parts of the aerosol valve of the prior art have the same numeral designation in FIG. 2, except for the valve stem, which is a novel feature of this invention. Also ports 32 are provided in the recess 24 for entry of the aerosol container contents into the hollow valve stem (to be described hereafter).

An aspect of the novel structure of the aerosol valve of this invention concerns the valve stem, generally designated as 10, and particularly concerns the terminal or discharge end 36 of the valve stem 34.

The valve stem end 36, distal to the valve body, terminates in a deformable membrane flange 38.

The membrane flange 38 is a short, thin extension atop the terminal edge of the valve stem 36, what is often called in the molding of plastics as a "flash." FIG. 3 shows a perspective view of the valve stem 34 and valve body 12 having a recessed portion at the valve stem/valve body junction. The numbered parts of the valve stem/valve body are the same as described for FIGS. 1 and 2.

Figure 4:
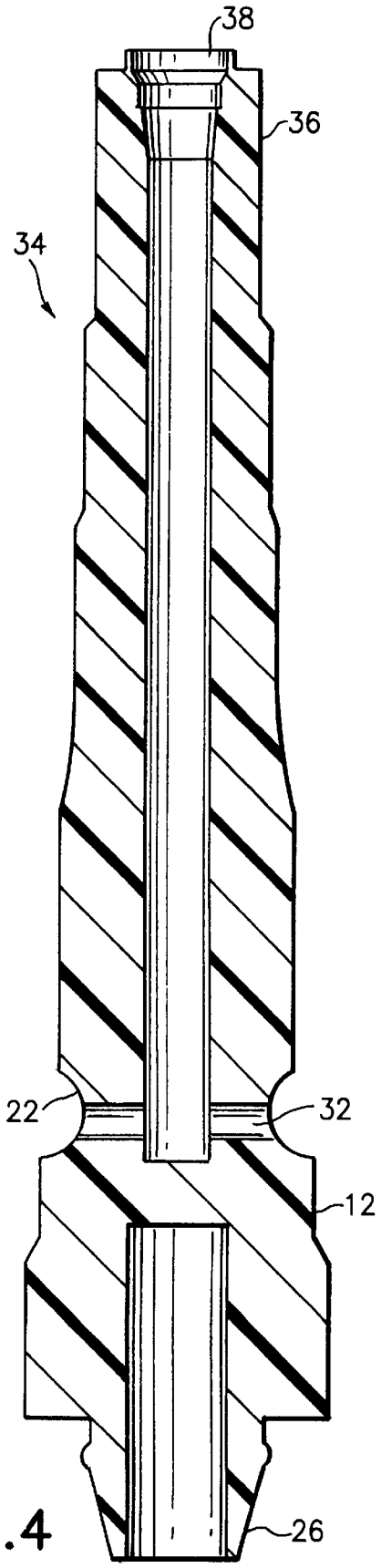
FIG. 4 is a sectional view of the aerosol valve stem and valve body of this invention.

FIG. 4 is a sectional view through line 4—4 of FIG. 3. The numbered parts of the valve stem/valve body are the same as described for FIGS. 1 and 2.

FIG. 5 is a partial section of the membrane flange 38, as molded, and prior to advancing the pressurized container into the opening of the container, say a cigarette lighter, into which the aerosol product is to be transferred.

In the usual lighter, having a side entry port in the pin, a centrally disposed pin is surrounded by a depressible collar, which collar upon being depressed exposes the side entry port. The membrane flange 38 will effectively seal against the collar surrounding the pin.

It has been found that molding an annular membrane flange offset about 0.010" from the outer edge of the conduit 18; said flange being 0.012" in height, 0.004", thick and having a diameter of 0.069", will work satisfactorily. Nylon is a suitable material for the valve body and stem. Also note that in the preferred form, the portion 26 of the conduit 18 contiguous to the flange is chamfered.

It will be understood that various changes and modifications may be made in the details of construction without departing from the spirit of the invention.

What is claimed is:

1. In a manually actuatable valve for an aerosol container, said valve comprising a mounting cup having a pedestal portion, an aerosol valve mounted in the pedestal portion of the mounting cup comprising a valve housing, a valve body disposed within the valve housing and being able to reciprocally move relative to the valve housing, said valve body having a valve stem with a conduit therethrough extending through an opening in the pedestal portion of the mounting cup and having a terminus outside the mounting cup, said valve stem being in communication with the contents of the aerosol container when the valve is open and closed to the container contents when the valve is closed, the improvement comprising disposing an integral annular membrane flange atop the terminus of the valve stem distal to the valve body such that the inner surface of said flange will deform in a radially outward direction upon applying a force urging the valve stem against a surface.

2. The improvement of claim 1, and further wherein the annular membrane flange atop the edge of the valve stem distal to the valve body is radially outwardly offset.

3. The improvement of claim 2, and further wherein the terminal terminus of the conduit-bearing valve stem contiguous to the annular membrane flange is chamfered.

4. The improvement of claim 1 and further wherein the terminal edge of the conduit-bearing valve stem contiguous to the annular membrane flange is chamfered.

5. The improvement of claim 1, and further comprising a valve stem having oppositely disposed entry ports in the end of the valve stem contiguous to the valve body.

6. The improvement of claim 2, and further comprising a valve stem having oppositely disposed entry ports in the end of the valve stem contiguous to the valve body.

7. The improvement of claim 3, and further comprising a valve stem having oppositely disposed entry ports in the end of the valve stem contiguous to the valve body.

8. The improvement of claim 4, and further comprising a valve stem having oppositely disposed entry ports in the end of the valve stem contiguous to the valve body.

9. The improvement of claim 4, and further comprising a valve stem having oppositely disposed entry ports in the end of the valve stem contiguous to the valve body.

* * * * *